US005464304A

United States Patent [19]

Dittmar

[11] Patent Number: 5,464,304

[45] Date of Patent: Nov. 7, 1995

[54] METHOD FOR RECREATIONAL SURFACE CRACK REPAIR

[76] Inventor: William G. Dittmar, 105 S. Mahwah Rd., Mahwah, N.J. 07430

[21] Appl. No.: 289,020

[22] Filed: Aug. 11, 1994

[51] Int. Cl.[6] ..... E01C 11/04

[52] U.S. Cl. ..... 404/75; 52/741.4

[58] Field of Search ..... 404/72, 75; 52/741.4, 52/514, 514.5, 396.1, 395

[56] References Cited

U.S. PATENT DOCUMENTS

| | | | |
|---|---|---|---|
| 3,663,350 | 5/1972 | Stokes | 161/151 |
| 3,932,051 | 1/1976 | Cleary | 404/82 |
| 3,993,412 | 11/1976 | Drane | 404/28 |
| 4,113,401 | 9/1978 | McDonald | 404/75 |
| 4,265,563 | 5/1981 | Marzocchi et al. | 404/75 |
| 4,668,548 | 5/1987 | Lankard | 404/75 X |
| 5,185,013 | 2/1993 | Martin | 52/514 |

*Primary Examiner*—William P. Neuder
*Attorney, Agent, or Firm*—W. Patrick Quast

[57] ABSTRACT

An economical and easy-to-install method for repairing cracks, including structural cracks, in recreational surfaces is described. Cracks are cleaned and completely filled with a mixture containing a high strength acrylic polymer binder mixed with sand and cement to form a crack patch of harder consistency than the surrounding asphalt. The repaired crack is then covered with a liquid which dries to a non-adhering surface which in turn is covered over with a fabric capable of stretching and then returning to its own original shape. The fabric is covered with an acrylic adhesive, which when dry secures the fabric at its peripheral edges (which extend beyond the non-adhering surface) to the asphalt playing surface. In this manner, expansion and contraction of the asphalt surrounding the acrylic based crack patch is effectively isolated from the playing surface, preventing reflective cracking in the playing surface for extended periods of time.

8 Claims, 5 Drawing Sheets

METHOD FOR RECREATIONAL SURFACE CRACK REPAIR

BACKGROUND

This invention relates to methods for repairing cracks in recreational surfaces, and in particular to a method for repairing cracks in asphalt surfaced tennis courts.

Crack repair in paving materials used for roadways, and other concrete or asphalt covered surfaces usually present a continuous maintenance problem. And, of course, in the case of recreational surfaces such as tennis courts and the like, a cracked playing surface often renders the court unplayable. A repair can be effected by resurfacing the entire area, but this is an obviously costly solution. Repairing just the area containing the crack or cracks would be the most economical approach to these problems if the repair lasted for a practically long period of time, and could be accomplished without altering the playing characteristics of the tennis court.

The traditional method for repairing cracks in a tennis court has been to cover the crack with FIBERGLAS (a registered trademark of Owens Corning Fiberglas), and then to bond the fabric to the asphalt surface with an adhesive. However, pressures created principally due to weather conditions of freezing and thawing will often cause the fabric to tear, necessitating frequent repairs to the same cracked area.

In order to overcome these powerful forces of nature which tend to re-create a crack over and over again in the same area a number of paving and paving repair methods have been proposed utilizing the principle of a slip-sheet to deal more effectively with these forces. For example, U.S. Pat. No. 3,663,350 teaches utilizing an elastomeric layer 14 (FIG. 2) between a surface layer 11 and a concrete layer 20 (FIG. 2) for roofing, garage decks, and so on. The elastomeric layer permits toleration of considerable expansion, contraction, and/or cracking of the concrete without affecting the surface layer. In U.S. Pat. No. 3,932,051 a method is described for strengthening highway pavements and other load bearing pavements. This patent teaches, col. 2, lines 47–52, "first imposing a non-adhesive mastic-backed sheets 16 of 400 mm. wide aluminum foil or similar slip surface material to allow a spread of strain in the layer and reduce the chance of reflective cracking in the wearing course occurring during thermal movement of the concrete." In U.S. Pat. No. 3,993,412 a method for resurfacing tennis courts and the like to prevent reflective cracking (i.e. cracks that re-appear in the same area after a repair) is described. The method makes use of multiple layers of a free floating flexible material on the top of an existing surface, which is then coated with a new asphalt surface. Another method for dealing with cracks in a paving material for tennis courts and the like is disclosed in U.S. Pat. No. 5,185,013. This method is commercially marketed by Robert A. Martin, Inc. as the "OMEGA SYSTEM". In this method a crack in the paving material is repaired by first lowering the surface area surrounding the crack, cleaning and filling the crack, covering the crack with a fabric having an adhesive front and a non-adhesive back (e.g. 2" wide duct tape), covering the fabric with a reinforcing material, and then building up an overlay material to a depth to match the original level of the paving surface under repair.

While the above cited patents disclose useful approaches to repairs in paving materials, the present invention describes a simple and economical method for long term repair of paving materials, and in particular structural cracks in asphalt surfaced tennis courts.

Accordingly, it is a primary object of the invention to provide for long term repair of cracks in a recreational surface.

A further object is to effect an economical repair of cracks in a recreational surface.

Still another object of the invention is to provide a crack repair method that is easy to install on a recreational surface.

An additional object of the invention is to provide long term repair of structural cracks in a recreational surface.

SUMMARY

These and other objects are obtained in the instant invention of a method for repairing cracks in recreational surfaces.

I find that a long term effective repair for tennis court surfaces and the like can be accomplished in a relatively inexpensive and easily installed manner. Typically, a crack repaired surface on a tennis court will re-appear within one years time. This is particularly the case with the so called "structural" crack (i.e. a crack extending from the surface of the asphalt to the base of the asphalt) in a tennis court covered with an asphalt surface. Standard methods of repair usually make use of sheets of FIBERGLAS bonded to the asphalt surface over the cracks. During winter conditions, expansion and thawing of materials within or adjacent a repaired crack often cause the crack to re-appear, and for the FIBERGLAS fabric to tear. These freeze-thaw forces are great, and present a difficult problem in tennis court surface repair.

I have found, however, that isolating the crack from the tennis court playing surface results in a long term repair, even for "structural" cracks. My method employs a slip-sheet, or non-adhering delaminated surface area, applied between the crack and the playing surface.

To effect a repair, the crack is first cleaned as well as possible with, for example, a high pressure water stream. The crack is then filled with an acrylic mortar and allowed to dry. A roller is then employed to apply a coat of liquid water proofing material over the area of the crack, the line of the crack forming the center line for applying this water proofing liquid coating, which dries to a non-adhering surface. A flexible and elastic fabric is then placed over this non-adhering surface, with a perimeter area of the fabric extending beyond the non-adhering area. A high strength liquid acrylic binder is then applied over this fabric, causing the fabric to be bonded at the periphery of the fabric to the asphalt surface. The fabric over the slip-sheet, or delaminated, or non-adhering water proofed area, remains unbonded, leaving a large slip-sheet area. The surface of the tennis court is then painted and/or otherwise finished in a conventional manner.

The fabric described above is capable of a degree of elongation, with excellent "memory" qualities which enable the fabric to quickly return to its original size when externally applied forces dictate. When a crack expands due to thermal forces over a period of time, the fabric is able to elongate, but at a reduced rate. Also when the pressure from the weight of a human foot is placed on a specific area, the acrylics and non-adhering coating will tend to have a high coefficient of friction at this point. This will tend to help stabilize the fabric in place, not having to rely strictly on the integrity of the fabric and its bond to the original surface.

Thus an economical, easy-to-install, long term repair of recreational surfaces is effected. The invention has been described above primarily in connection with recreational surfaces such as tennis courts, but the method may also be successfully employed in a wide variety of paving material crack repairs.

DETAILS

Figure 1:
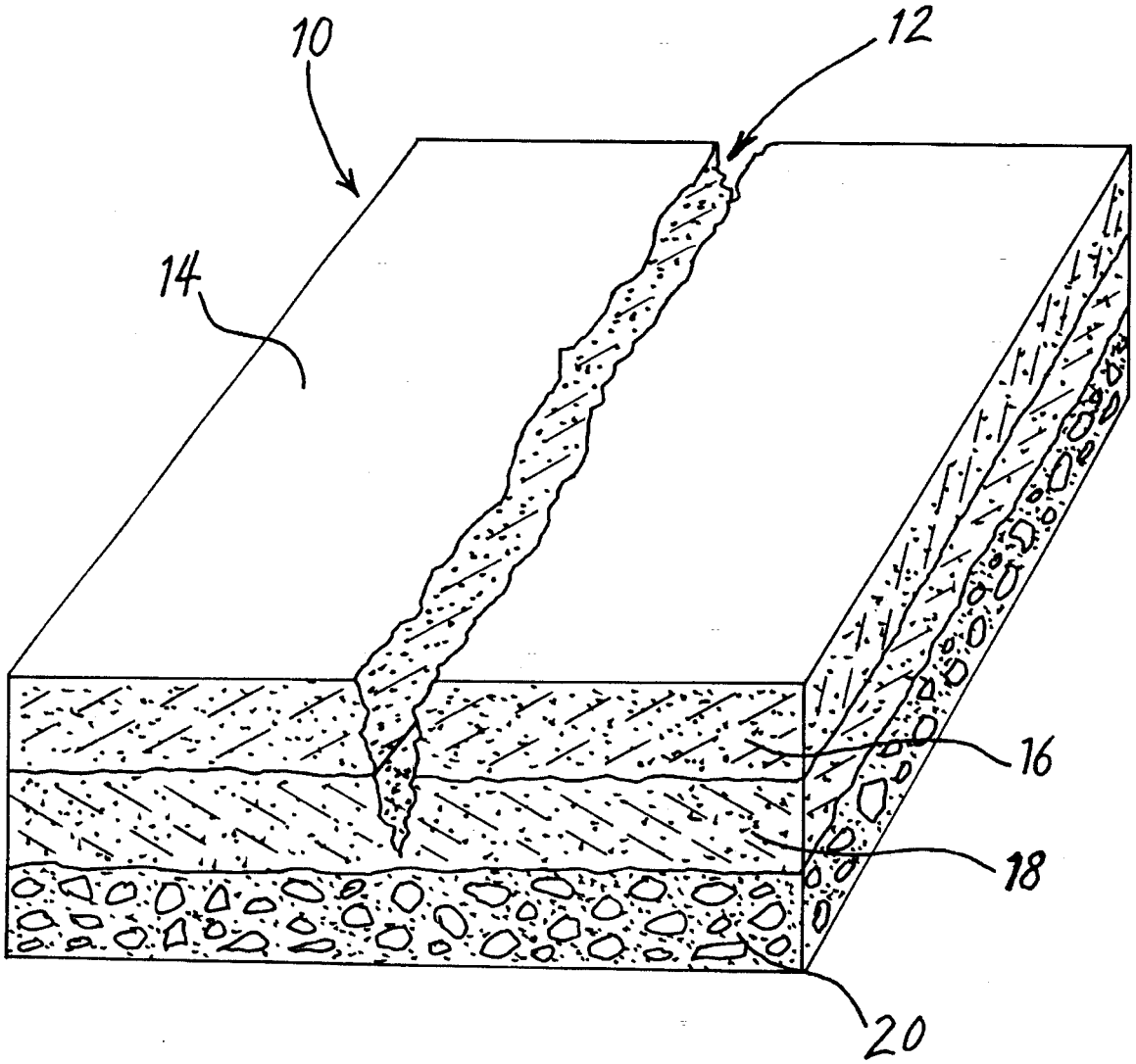
FIG. 1 is a perspective, sectional view of a typical recreational surface having a structural crack within its surface.

Referring now to the drawings, in FIG. 1 a typical asphalt covered recreational surface 14 such as the surface of a tennis court 10 is shown having a structural crack 12. A typical tennis court as might be found in the northeastern United States would have a top asphalt surface 16, 18 generally 3½" to 4" thick. The asphalt surface is usually placed over an approximately 4" subbase 20 of a stone blend commonly referred to as the "quarry process". The size of stones used varies from 1" in diameter to the size of dust particles. The asphalt is placed over the stone subbase in two lifts, the first lift 18 comprising a mix of asphalt and FABC (fine aggregate bituminous concrete) having large stones of up to 1" diameter for strength, and a second lift 16 which forms the top surface layer of the tennis court 10 comprising a mix of asphalt and FABC having smaller stones of up to ⅜" in diameter to create a finer, smoother, less porous mix. The top playing surface 14 of the tennis court 10 is usually finished with an approximately 1/16" thick coating of acrylic material mixed with sand. Different sieves of sand can be mixed with this acrylic layer, finer sieves yielding a faster ball when striking the surface, and coarser sieves providing a slower ball when striking the surface. Elastomeric materials can also be added to the acrylic layer to reduce "shock" when a foot strikes this surface.

Figure 2:
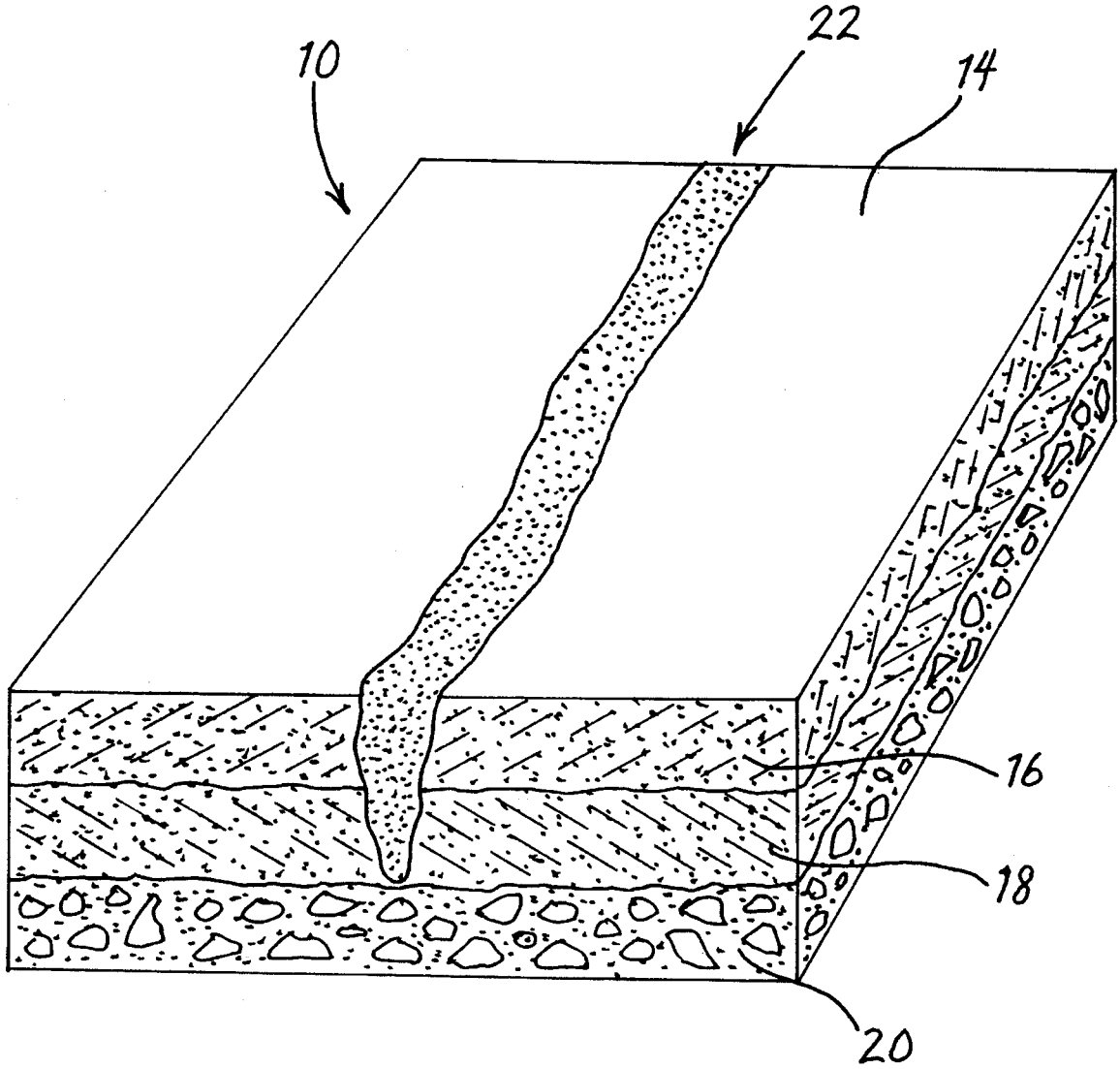
FIG. 2 is a perspective view of the recreational surface of FIG. 1, showing the crack as filled in with a repair material.

In FIG. 2 the crack 12 shown in FIG. 1 is depicted as being filled in with a crack filling material 22. In the case of the structural crack 12 (i.e. a crack extending throughout the depth of the asphalt, extending from the surface 14 of the tennis court 10 to the stone base 20) it must be kept in mind that the crack will almost certainly re-develop due to the freezing and thawing forces of nature. No matter how strong a binder is used, as, for example, a strong epoxy binder, the low tensile strength of the bound asphalt will almost inevitably crumble apart, setting the stage for a reflective crack to appear on the surface 14 of the court. This being the case, it is important to completely fill the crack using a liquid or wet material. It is also important that this crack filling material be harder than the asphalt to prevent the asphalt from crushing this area during weather related movement of the asphalt. Before filling the crack it should be cleaned as well as possible, as, for example, with a high pressure stream of water such as a power washer.

A high strength acrylic latex bonding liquid mixed with silica sand and portland cement forms a wet mortar that will completely fill the crack 12, and, when dry, be harder than the surrounding asphalt, thereby preventing subsequent re-entry of the asphalt into this area. A suitable wet mortar for this purpose is "Court Patch Binder", which is a high strength acrylic bonding liquid designed to be mixed with silica sand and portland cement, available from California Products Corporation, 169 Waverly Street, Cambridge, Mass. 02139.

Figure 3:
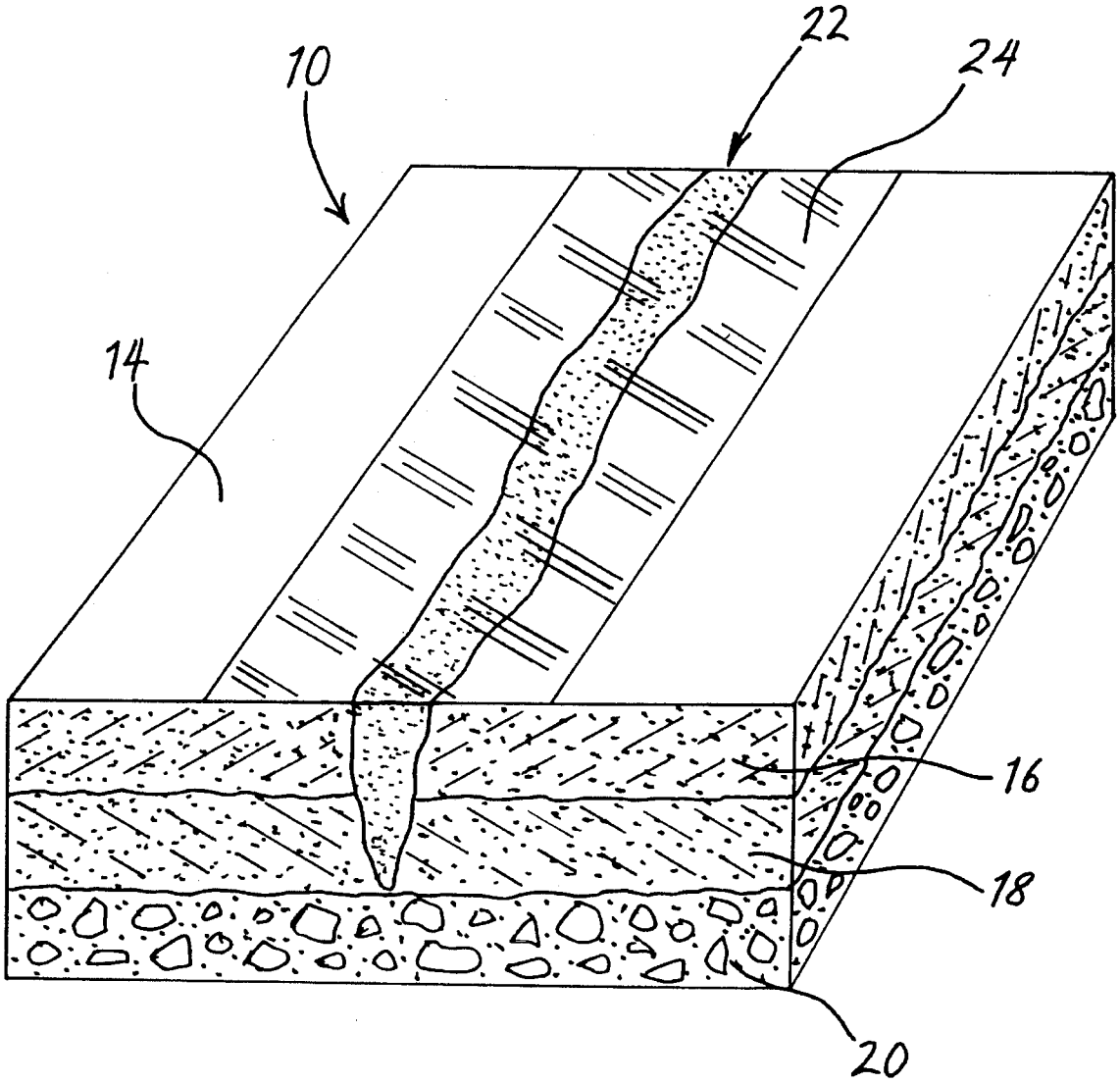
FIG. 3 is a perspective view of the recreational surface of FIG. 2, showing a non-adhering coating in place over the filled crack.
Figure 4:
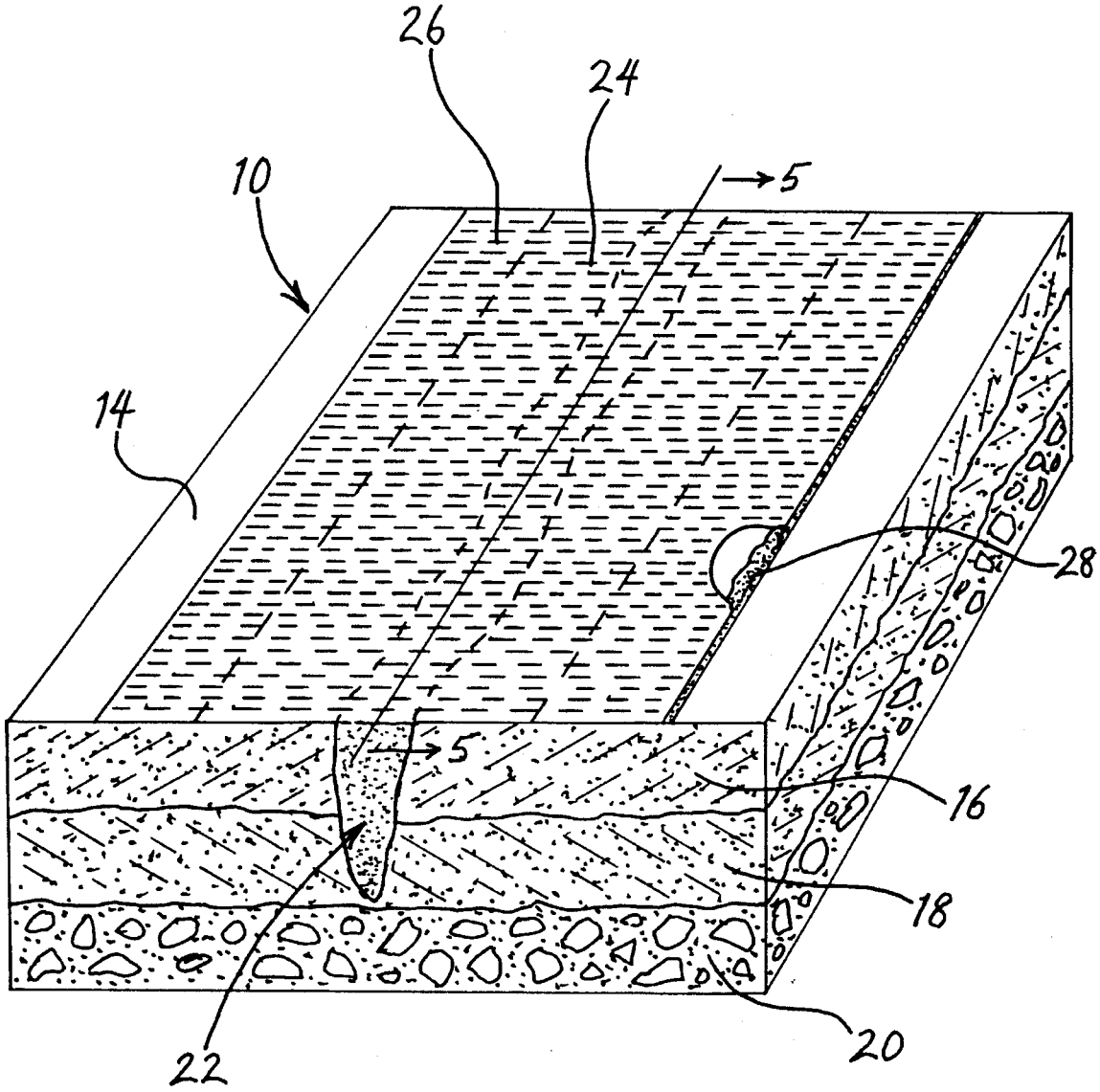
FIG. 4 is a perspective view of the recreational surface of FIG. 3, showing a fabric adhesively secured to the surface, covering the non-adhering coating.

As shown in FIG. 3, after the crack filling acrylic mortar 22 has dried, a non-adhering flexible coating 24 is applied over the top surface of the crack and an area of the top surface 14 of the tennis court immediately adjacent the crack. The purpose of this coating is to provide a slip-sheet, or delaminated, or non-adhering area, between the top surface of the crack and the top surface 14 of the tennis court after the crack has been filled. The non-adhering coating is best applied as a liquid film. An example of a suitable flexible, non-adhering coating is a two component liquid aliphatic urethane. An example of this type of material is "Polagard A.G." available from Plastics & Resins, Inc., 850 Glen Avenue, P.O. Box 392, Moorestown, N.J. 08057-0392. Polagard A.G. has the following technical characteristics:

| | | |
|---|---|---|
| Flexibility at low temp | 180 bend @ 20 degrees F. | ASTM C-711 |
| Elongation-unsupported film | 10% | ASTM D-412 |
| Tensile strength | 3,000 lbs./sq. in. | ASTM D-412 |
| Total solids content (B.W.) | 35% | ASTM D1044 |
| Flashpoint | 91 degrees F. | FTMS 141A (MA293) |
| Abrasion resistance | 27 lit/mil | ASTM D-968-51 |
| Shore "A" hardness | 97 | ASTM D2240 |
| Moisture vapor trans | 1.84 gms/M2/ 24 hrs + 0.16 perms | ASTM E96 |
| U.V. resistance | no chalking or deterioration passes 5 years. | |
| Chemical resistance | Alcohols, ketones, | ASTM D-1308 |

A convenient method for applying the liquid is by means of a nine inch roller (not shown) centered over the crack. This then provides something on the order of 4½" of slip-sheet material on either side of the crack when the liquid dries. The width of this delaminated area is based on tile width of the crack to be repaired. Typically this width would range between 7 to 24 inches. Normally it would fall in the 9 to 12 inch range. This delaminated area is of great importance in preventing reflective cracking in asphalt repairs, and especially for structural cracks. For example, if a crack opens a total of one half inch due to movement from frost, by having a delaminated area over this crack of nine inches, the stress is only multiplied by 0.06 anywhere inside the nine inches. The flexibility of the coating also permits a recovery under opposite temperature changes so that the planarity of the surface is unaffected.

Finally, to complete the repair in the cracked asphalt, an elastic, flexible fabric 26 having special characteristics is placed over this non-adhering coating 24 and cemented to the asphalt top surface 14 at a peripheral area extending beyond the outer edges of the non-adhering coating 24 by means of a high strength acrylic binder 28. High strength acrylic binders of this type are conventional, and well known to the art. I find a 24" wide section of the fabric 26, with the acrylic binder being applied throughout the fabric and "squeegeed" out with a roller to remove excessive acrylic, is usually adequate for a long lasting repair. Other arrangements of the fabric, such as 18" widths or 40" widths can be employed depending on circumstances. Additionally, two layers of the selected fabric 26 can be employed without changing the planarity, i.e. the playing characteristics of the tennis court top surface 14.

The fabric 26 selected should be soft, relatively thin, and have good tensile and tear strength. In addition the fabric must be capable of a reasonable degree of elongation and have good "memory", i.e. the ability to quickly return to its original shape almost immediately after it has been stretched. This is important in preventing crack recurrence since the fabric 26 must cooperate with the flexible, non-adhering coating 24 and the acrylic binder 28 (which also is capable of a small amount of elongation) to prevent crack recurrence. A fabric found to be suitable for this application is Roofab, which is a bi-axially oriented, woven fabric of polyester. Typical thicknesses are on the order of 0.015". Roofab is available from the Andek Chemical Corp., 850 Glen Avenue, P.O. Box 392, Moorestown, N.J. 08057-0392. Roofab has the following technical characteristics:

| | |
|---|---|
| Weight | 3.00 oz/sq. yard |
| Thickness | 0.015" |
| Ball bursting strength/pounds | 69 |
| Tensile (grab) | 73/42 |
| Tear (trapezoid) | 17 × 26 |
| Elongation at break | up to 20% |

Figure 5:
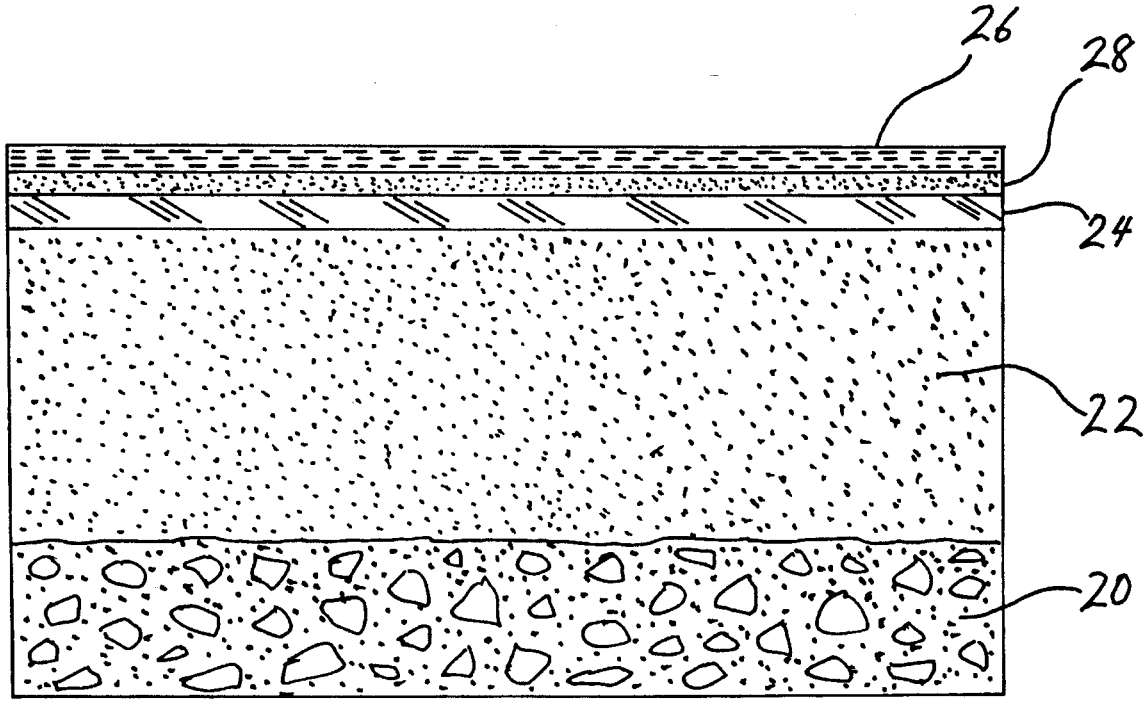
FIG. 5 is a side elevation, sectional view of the crack in a recreational surface as repaired by the method of the invention, taken along the line 5—5 of FIG. 4.

FIG. 5 is a sectional view of the completed repair of the structural crack 12. Crack filling material 22 is shown completely filling the void area of the crack 12. The top surface of the crack is covered with a non-adhering coating 24, and that coating in turn is covered by the above characterized fabric 26 cemented to the asphalt playing surface 14 at the peripheral edges of the fabric by means of a high strength acrylic binder 28. The surface 14 of the tennis court 10 may now be painted or otherwise cosmetically treated with standard, conventional procedures.

Thus it can be seen that an economical, easy-to-install, and long lasting method for repairing cracks in recreational surfaces is provided. Cracks, including the previously virtually impossible to long term repair "structural" cracks, are now swiftly corrected using the method of the invention, and for extremely practical prolonged time periods.

Although the above described embodiments are preferred, I expect that performance and durability of the invention can be further enhanced. This can be accomplished if a non-adhering coating material can be utilized in place of Polagard A.G. The requirement for the replacement material would be that it not bond, chemically or mechanically, to the fabric, but will exhibit an increased coefficient of friction between the non-adhering coating and the fabric. It is anticipated that this will improve the long term integrity of the fabric further by minimizing the torsional forces exerted by a player's foot at the location of the repair.

While the present invention has been disclosed in connection with versions shown and described in detail, various modifications and improvements thereon will become readily apparent to those skilled in the art. Accordingly, the spirit and scope of the present invention is to be limited only by the following claims.

What is claimed is:

1. A method for repairing recreational surfaces, comprising the steps of:

(a) cleaning a crack within said surface;

(b) filling said crack with a crack filling material;

(c) covering said crack at the exposed outer surface of said crack, and an area surrounding said crack in said recreational surface, with a liquid material which, when it dries bonds to the exposed outer surface of said filled crack and area surrounding said crack, said liquid material when dried resulting in an exposed, non-adhering surface;

(d) overlaying said non-adhering surface with a fabric material, said fabric material extending a spaced distance at its periphery beyond said non-adhering surface;

(e) covering said fabric material with a liquid adhesive material; and (f) allowing said liquid adhesive material to dry, whereby said periphery of said fabric material which extends beyond said non-adhering surface is adhesively secured to the surface coextensive with said fabric and surrounding said non-adhering surface.

2. The method according to claim 1 wherein said recreational surface is an asphalt surface on a tennis court.

3. The method according to claim 1 wherein said crack is a structural crack.

4. The method according to claim 1 wherein said crack filling material is a combination of acrylic binder, sand, and cement.

5. The method according to claim 1 wherein said non-adhering material is a liquid, aliphatic, two component urethane coating material.

6. The method according to claim 5 wherein said two component urethane material has the technical characteristics of Polagard A.G.

7. The method according to claim 1 wherein said fabric is a bi-axially woven fabric comprised of a plastic material.

8. The method according to claim 7 wherein said fabric has the technical characteristics of Roofab.

* * * * *